US010927718B2

(12) United States Patent
Hirschmann

(10) Patent No.: US 10,927,718 B2
(45) Date of Patent: Feb. 23, 2021

(54) VARIABLE VALVE DRIVE

(71) Applicant: MAN Truck & Bus SE, Munich (DE)

(72) Inventor: Steffen Hirschmann, Neustadt an der Aisch (DE)

(73) Assignee: MAN TRUCK & BUS SE, München (DE)

( * ) Notice: Subject to any disclaimer, the term of this patent is extended or adjusted under 35 U.S.C. 154(b) by 12 days.

(21) Appl. No.: 16/401,680

(22) Filed: May 2, 2019

(65) Prior Publication Data

US 2019/0338681 A1 Nov. 7, 2019

(30) Foreign Application Priority Data

May 4, 2018 (DE) ..... 10 2018 110 714.5

(51) Int. Cl.

| | |
|---|---|
| ***F01L 1/18*** | (2006.01) |
| ***F01L 1/344*** | (2006.01) |
| ***F01L 13/00*** | (2006.01) |
| ***F01L 13/06*** | (2006.01) |

(52) U.S. Cl.

CPC ..... *F01L 1/34413* (2013.01); *F01L 13/0036* (2013.01); *F01L 13/06* (2013.01); *F01L 2013/0052* (2013.01)

(58) Field of Classification Search

CPC ..... F01L 1/34413; F01L 1/3443; F01L 13/06; F01L 13/0036; F01L 2013/0052; F01L 2820/02

See application file for complete search history.

(56) References Cited

U.S. PATENT DOCUMENTS

2017/0284240 A1 10/2017 Takada et al.

FOREIGN PATENT DOCUMENTS

| | | | |
|---|---|---|---|
| DE | 19611641 | C1 | 6/1997 |
| DE | 102011050484 | A1 | 11/2012 |
| DE | 102015213266 | A1 | 1/2017 |
| DE | 102017205463 | A1 | 10/2017 |
| DE | 102017114575 | A1 | 1/2019 |
| EP | 3421741 | A1 | 1/2019 |

*Primary Examiner* — Zelalem Eshete

(74) *Attorney, Agent, or Firm* — Weber Rosselli & Cannon LLP

(57) ABSTRACT

The present disclosure relates to a variable valve drive, in particular with a sliding cam system, for an internal combustion engine. The variable valve drive has a shaft and a cam carrier which is arranged rotationally conjointly and axially displaceably on the shaft and which has a first cam and a second cam. The variable valve drive has an actuator device for axially displacing the cam carrier, and has a carrying device which at least partially engages around a lever axle of a force transmission device and carries the actuator device. The variable valve drive can offer the advantage that an arrangement of the actuator device which is expedient in terms of structural space is made possible in the region of the lever axle. At the same time, support of the actuator device by means of the carrying device on the lever axle can stiffen the flexible lever axle by means of the engaging-around configuration.

18 Claims, 4 Drawing Sheets

VARIABLE VALVE DRIVE

BACKGROUND

The disclosure relates to a variable valve drive, in particular with a sliding cam system, for an internal combustion engine.

Valve-controlled internal combustion engines have one or multiple controllable inlet and outlet valves per cylinder. Variable valve drives permit a flexible activation of the valves in order to vary the opening time, closing time and/or the valve lift. In this way, the engine operation can be adapted for example to a specific load situation. For example, a variable valve drive can be realized by means of a so-called sliding cam system.

DE 196 11 641 C1 has disclosed an example of a sliding cam system of said type, by means of which the actuation of a gas exchange valve with multiple different lift curves is made possible. For this purpose, a sliding cam with at least one cam portion which has multiple cam tracks is mounted rotationally conjointly but axially displaceably on the camshaft, which sliding cam has a lift contour into which an actuator in the form of a pin is inserted from radially outside in order to generate an axial displacement of the sliding cam. By means of the axial displacement of the sliding cam, a different valve lift is set at the respective gas exchange valve. The sliding cam, after the axial displacement thereof relative to the camshaft, is thereby locked in its axial relative position on the camshaft.

The sliding cam system can take up a considerable amount of structural space. In particular, an arrangement of the actuators for displacing a cam carrier (sliding cam) can constitute a challenge in the case of restricted space conditions. Typically, the actuators are fastened to a frame which is connected to the cylinder head or cylinder head cover.

DE 10 2011 050 484 A1 has disclosed an internal combustion engine with multiple cylinders, a cylinder head and a cylinder head cover. For the actuation of gas exchange valves, at least one rotatably mounted camshaft with at least one sliding cam which is axially displaceable on the respective camshaft is provided. The respective sliding cam has at least one slotted-guide portion with at least one groove. An actuator is provided for effecting an axial displacement of the respective sliding cam. The actuator is mounted in the cylinder head or in the cylinder head cover.

DE 10 2017 205 463 A1 has furthermore disclosed a sliding cam system in which actuators for displacing a cam carrier extend partially through switching drive shafts which act as lever axles, which have corresponding passage holes for this purpose.

Even though an arrangement of actuators of a sliding cam system in or on lever axles may be advantageous with regard to structural space considerations, this can lead to undesired bending of a flexible lever axle owing to forces for displacing the cam carrier that arise during the operation of the actuators. A passage opening in the lever axle, as in the prior art according to DE 10 2017 205 463 A1, can even additionally weaken the lever axle and make it more flexible.

The present disclosure is based on the object of providing an alternative and/or improved variable valve drive with which, in particular, the stated disadvantages of the prior art can be overcome.

The object is achieved by means of the features of the independent claim. Advantageous refinements are specified in the dependent claims and in the description.

SUMMARY

The present disclosure provides a variable valve drive, in particular with a sliding cam system, for an internal combustion engine. The variable valve drive has a shaft and a cam carrier. The cam carrier is arranged rotationally conjointly and axially displaceably on the shaft (for example by means of an axial profiling, in particular toothed-shaft connection or spline connection). The cam carrier has a first cam and a second cam. The variable valve drive has a force transmission device with a lever axle (for example rocker lever axle or valve lever axle) and a force transmission element, in particular a valve lever or a rocker lever. The force transmission element is pivotable about the lever axle and, in a manner dependent on an axial position of the cam carrier, selectively produces an operative connection between the first cam and a gas exchange valve (for example inlet valve or outlet valve of a cylinder) of the internal combustion engine or between the second cam and the gas exchange valve. The variable valve drive has an actuator device for axially displacing the cam carrier, and has a carrying device which at least partially engages around the lever axle and carries the actuator device (in particular on the lever axle).

The variable valve drive can offer the advantage that an arrangement of the actuator device which is expedient in terms of structural space is made possible in the region of the lever axle.

At the same time, support of the actuator device by means of the carrying device on the lever axle can stiffen the flexible lever axle by means of the engaging-around configuration. In this way, secure hold of the actuator device by means of the carrying device on the lever axial can be ensured.

The actuator device may expediently be an electric (for example electromagnetic or electromotive), pneumatic and/or hydraulic actuator device.

In one exemplary embodiment, the actuator device, in particular a first actuator and a second actuator of the actuator device, are at least partially received in the lever axle. Such an arrangement may be particularly expedient in terms of structural space.

For example, the first actuator may be at least partially received in a first receiving hole, in particular a passage hole, of the lever axle, and/or the second actuator may be at least partially received in a second receiving hole, in particular a passage hole, of the lever axle. It is possible for the first receiving hole and/or the second receiving hole to extend perpendicular to a longitudinal direction of the lever axle and/or to be oriented in the direction of the cam carrier.

In a further exemplary embodiment, the actuator device, in particular a first actuator and a second actuator of the actuator device, are carried by the carrying device (for example entirely) outside the lever axle.

In one embodiment, the carrying device is designed such that it stiffens the lever axle by means of the engaging-around configuration, and/or reduces a flexibility of the lever axle and/or increases a flexural stiffness of the lever axle. Alternatively or in addition, the carrying device has at least one contact surface, which fits together with the outer circumferential surface of the lever axle and which is in particular of circular-cylinder-segment-shaped form (and which in particular makes contact with the outer circumferential surface of the lever axle), for at least partially engaging around the lever axle, which contact surface stiffens the lever axle by means of the engaging-around configuration, and/or reduces a flexibility of the lever axle and/or increases a flexural stiffness of the lever axle.

In a further embodiment, the carrying device is (for example detachably) attached (for example fastened) by means of a clamping connection to the lever axle, and/or the carrying device forms a ring-shaped clamp for the lever axle.

In one design variant, the carrying device engages in multi-part (for example two-part) form around the lever axle. Alternatively or in addition, the carrying device has a first carrying element and a second carrying element which are (for example detachably) fastened to one another and which each have a receiving shell, in particular a receiving half-shell, for forming a receptacle (for example a circular cylindrical hole) for the lever axle.

For example, the first carrying element may be detachably fastened by means of multiple, in particular detachable, fastening elements, for example screws, to the second carrying element.

It is also possible for the first carrying element and the second carrying element to be formed integrally as a single piece and/or for the carrying device to be formed in one piece. For example, the carrying device, or the two carrying elements, may be shrink-fitted onto the lever axle (for example similarly to the case in an assembled camshaft).

It is expediently possible for one or more actuator receiving holes of the first carrying element and/or of the second carrying element to open into the receiving shell of the first carrying element and/or of the second carrying element.

In a further design variant, the carrying device is secured axially and/or rotationally conjointly on the lever axle; in particular by means of a pin, in particular by means of a single pin. Alternatively or in addition, the first carrying element and/or the second carrying element is secured axially and/or rotationally conjointly on the lever axle; in particular by means of a pin, in particular by means of a single pin.

In one exemplary embodiment, one or more actuators of the actuator device are received in the carrying device. Alternatively or in addition, one or more actuators of the actuator device are received in the first carrying element and/or one or more actuators of the actuator device are received in the second carrying element.

For example, the first carrying element and/or the second carrying element may have one or more receiving holes, in particular passage holes, in which one or more actuators of the actuator device are received. For example, the receiving holes of the first carrying element, of the lever axle and/or of the second carrying element may be oriented with one another or in alignment.

In a further exemplary embodiment, the carrying device (for example the first carrying element, which faces toward the cam carrier) has one or more receiving holes for receiving one or more actuators of the actuator device. Additionally, the one or more receiving holes has a (for example encircling) shoulder on which the one or more actuators is supported for the purposes of accommodating transverse forces. It is thus possible, for example, to prevent transverse forces from being introduced directly into the lever axle.

In one embodiment, the first carrying element and the second carrying element are attached (for example fastened) by means of a clamping connection to the lever axle. Alternatively or in addition, the first carrying element and the second carrying element form a ring-shaped clamp for the lever axle. Alternatively or in addition, the first carrying element and the second carrying element make contact with one another on one side of the lever axle and are spaced apart from one another on an opposite side of the lever axle for the clamping of the lever axle. A clamping action in the region in which the first carrying element and the second carrying element are spaced apart from one another may be set or effected for example by tightening of one or more detachable fastening elements, for example screws, in this region.

In a further embodiment, the lever axle has an in particular eccentric fluid longitudinal channel, in particular for the feed of lubricating fluid for the lubrication of a bearing point of the force transmission element, which fluid longitudinal at least partially crosses (intersects) a receiving hole of the lever axle for the actuator device. Alternatively or in addition, the carrying device is sealed off in order to prevent leakage (for example of fluid from the fluid longitudinal channel).

For example, a seal, for example an O-ring, may be arranged in an actuator receiving hole of the first carrying element and/or of the second carrying element. It is possible for a seal, for example an O-ring, to be arranged in a further actuator receiving hole (for example for a second actuator) of the first carrying element and/or of the second carrying element.

It is expediently possible for the seal or the seals to be arranged in a circumferential groove of the respective actuator receiving hole.

In one design variant, the actuator device is (for example detachably) attached (for example fastened) by means of a flange plate (in particular externally) to the carrying device, in particular to a first carrying element of the carrying device.

In one refinement, the carrying device, in particular the first carrying element, has at least one recess on a surface facing toward the flange plate, in order to increase a flexible elasticity of the carrying device. It is thus for example possible to prevent excessively high stresses from arising in the second carrying element of the carrying device if forces must be supported by the carrying device during the operation of the actuator device.

In a further design variant, the carrying device, in particular a second carrying element of the carrying device, has a holding region for holding supply lines, in particular electrical supply lines, for the actuator device, in particular on a side of the carrying device averted from the cam carrier. Thus, the carrying device can perform a further function in addition to carrying the actuator device.

In one exemplary embodiment, the force transmission device has a further force transmission element, in particular a valve lever or a rocker lever, which is pivotable about the lever axle. Alternatively or in addition, the carrying device is arranged (in particular on the lever axle) as a spacer between the force transmission element and the further force transmission element, in particular so as to directly join the force transmission element and the further force transmission element. Thus, the carrying device can perform a further function in addition to carrying the actuator device.

The further force transmission element can expediently, in a manner dependent on an axial position of the cam carrier, selectively produce an operative connection between a third cam and a further gas exchange valve (for example inlet valve or outlet valve of a cylinder) of the internal combustion engine or between a fourth cam and the further gas exchange valve.

The actuator device may be designed in a variety of forms. It is possible for the actuator device to have one or more actuators which each have a movable pin. The pin, which is movable in particular in a radial direction of the shaft or of the cam carrier, may engage for example into a helical engagement track or switching slotted guide of the cam carrier in order to displace the cam carrier in an axial direction. It is possible for a first actuator of the actuator device to be designed to displace the cam carrier and a first axial direction by engaging into a first engagement track of the cam carrier. It is also possible for a second actuator to be designed to displace the cam carrier in a second axial direction, which is opposite to the first axial direction, by engaging into a second engagement track of the cam carrier.

It is expediently possible for the cam carrier, the shaft and the actuator device to form a sliding cam system.

The present disclosure also relates to a motor vehicle, in particular a utility vehicle (for example heavy goods vehicle or bus), having a variable valve drive as disclosed herein.

It is also possible to use the device as disclosed herein for passenger motor vehicles, large engines, off-road vehicles, static engines, marine engines, etc.

BRIEF DESCRIPTION OF THE DRAWINGS

The above-described embodiments and features of the present disclosure may be combined with one another in any desired manner. Further details and advantages will be described below with reference to the appended drawings. In the drawings.

DETAILED DESCRIPTION

The embodiments shown in the figures at least partially correspond, and therefore similar or identical parts are denoted with the same reference designations, and for the explanation of said parts, reference is also made to the description of the other embodiments or figures in order to avoid repetitions.

Figure 1:
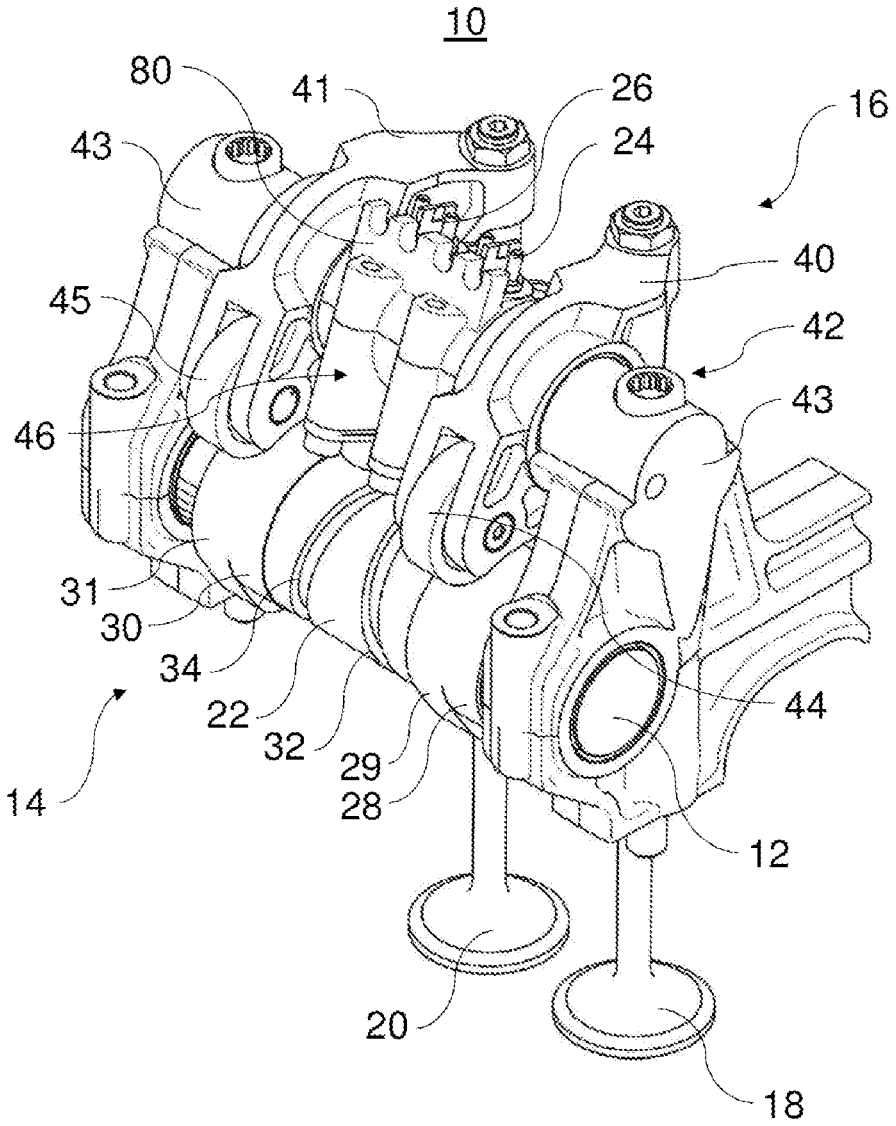
FIG. 1 shows an isometric view of an exemplary variable valve drive according to the present disclosure.
Figure 2:
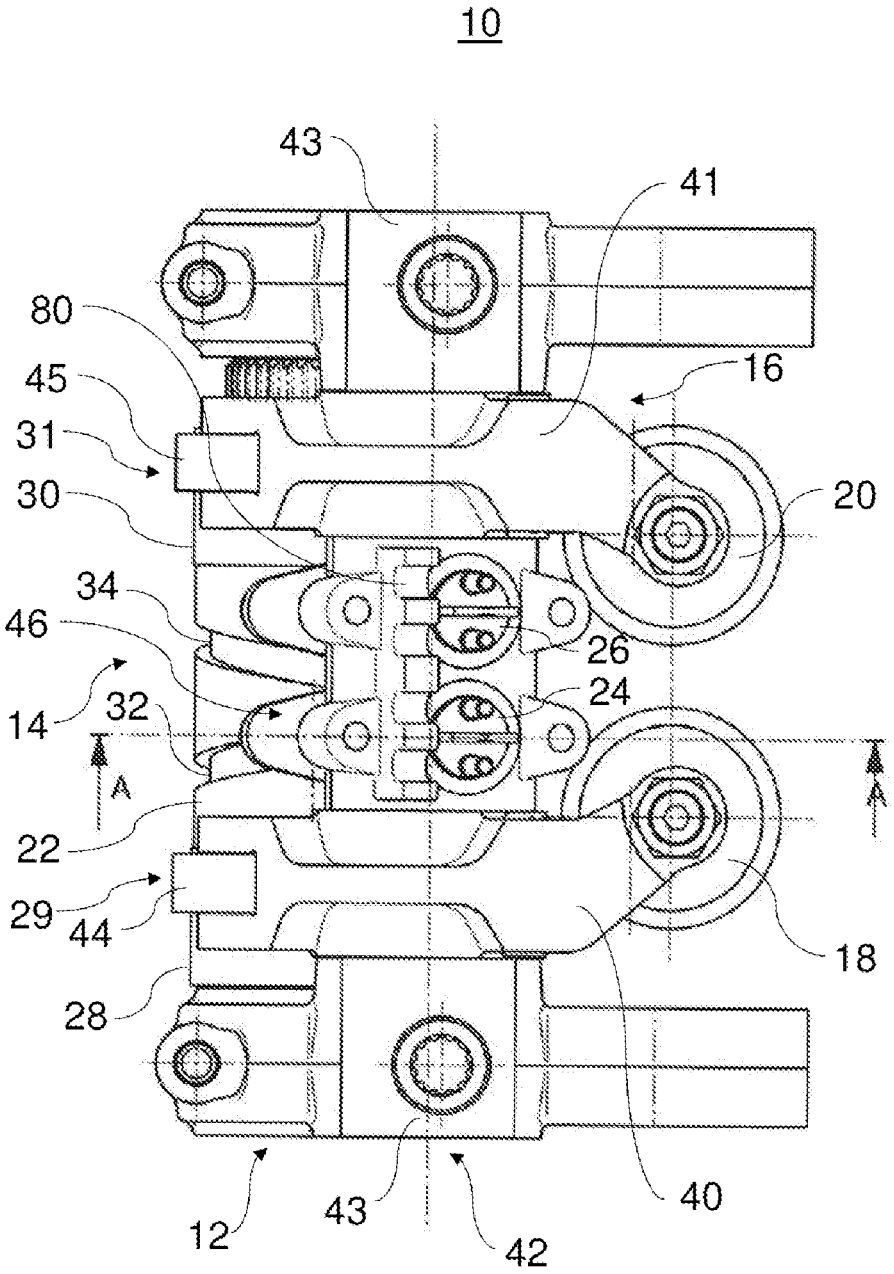
FIG. 2 shows a plan view, or a view from above, of the exemplary variable valve drive.

FIGS. 1 and 2 show a variable valve drive 10. The variable valve drive 10 has a shaft (camshaft) 12, a sliding cam system 14, a force transmission device 16, a first gas exchange valve 18 and a second gas exchange valve 20. The gas exchange valves 18, 20 may for example be inlet valves or outlet valves of a cylinder of an internal combustion engine.

The variable valve drive 10 may be used for adapting the valve control curves of the first and second gas exchange valves 18, 20. The variable valve drive 10 is assigned to an internal combustion engine (not illustrated). The internal combustion engine may for example be part of a utility vehicle, for example a bus or a heavy goods vehicle. The internal combustion engine may have one or more cylinders.

The sliding cam system 14 has a cam carrier 22 and an actuator device 24, 26 with a first actuator 24 and a second actuator 26.

The cam carrier 22 is arranged rotationally conjointly and axially displaceably on the shaft 12, for example by means of an axial profiling of the outer circumference of the shaft 12 and of the inner circumference of the cam carrier 22 (for example toothed shaft connection or spline connection). It is possible for multiple cam carriers 22 to be able to be arranged on the shaft 12, for example in order to actuate gas exchange valves of multiple cylinders of the internal combustion engine. The cam carrier 22 has four cams 28-31, a first engagement track (switching slotted guide) 32 and a second engagement track (switching slotted guide) 34.

The cam carrier 22 forms, together with the shaft 12, a camshaft. The shaft 12 with the cam carrier 22 is arranged as an overhead camshaft (OHC). The shaft 12 with the cam carrier 22 may be provided as part of a double camshaft system (double overhead camshaft—DOHC) or as a single camshaft (single overhead camshaft—SOHC).

The four cams 28-31 may have different cam contours in order to generate different valve control curves for the gas exchange valves 18, 20. The cams 28-31 may at least partially also be formed as zero-lift cams. The different cam contours of the cams 28-31 may be used for example for reducing fuel consumption, for thermal management or for realizing an engine brake.

The four cams 28-31 are arranged offset with respect to one another along a longitudinal axis of the cam carrier 22. The first cam 28 is arranged adjacent to the second cam 29. The third cam 30 is arranged adjacent to the fourth cam 31. The first and second cams 28, 29 serve selectively for the actuation of the first gas exchange valve 18. The third and fourth cams 30, 31 serve selectively for the actuation of the second gas exchange valve 20. The cams 28, 29 and 30, 31 are arranged at opposite ends of the cam carrier 22. In other embodiments, it is possible for additional cams, fewer cams and/or alternative arrangements of the cams to be provided, for example a central arrangement of the cams on the cam carrier.

The first engagement track 32 and the second engagement rack 34 are provided centrally on the cam carrier 22. It is also possible for the engagement tracks to be arranged eccentrically, for example at the ends on the cam carrier. The first and second engagement track 32, 34 extend helically as depressions (grooves) in the cam carrier 22 about a longitudinal axis of the shaft 12.

For the axial displacement of the cam carrier 22, it is possible for pins, which are displaceable radially with respect to the longitudinal axis of the shaft 12, of the actuators 24, 26 to engage selectively into the engagement tracks 32, 34. In detail, the pin of the first actuator 24 can engage selectively into the first engagement track 32 in order to displace the cam carrier 22 from one axial position to another axial position. The pin of the second actuator 26 can in turn engage selectively into the second engagement track 34. Then, the cam carrier 22 is displaced back from the other axial position. Depending on the axial position of the cam carrier 22, the gas exchange valves 18, 20 are actuated either by the first cam 28 and the third cam 30 or by the second cam 29 and the fourth cam 31. For example, the second gas exchange valve 20 is, in the illustrated axial position of the cam carrier 22, actuated by the fourth cam 31.

The axial displacement of the cam carrier 22 is triggered by virtue of the fact that the deployed pin of the respective actuator 24, 26 is positionally fixed with respect to an axial direction of the shaft 12. Consequently, the displaceable cam carrier 22 is, owing to the helical form of the engagement tracks 32, 34, displaced in a longitudinal direction of the shaft 12 if one of the deployed pins engages into the respective engagement track 32, 34. At the end of the axial displacement process, the deployed pin of the respective actuator 24, 26 is guided by the respective engagement track 32, 34 via a pushing-out ramp oppositely to the deployment direction and is thus retracted or thrown out. The pin of the respective actuator 24, 26 passes out of engagement with the respective engagement track 32, 34.

The actuators 24, 26 may be electrically (for example electromotively, electromagnetically), pneumatically and/or hydraulically actuated. In the embodiment illustrated, the actuators are electrically actuated (see the electrical terminals at the upper ends thereof).

The siding cam system 14 may additionally have a locking device (not illustrated). The locking device may be designed so as to secure the cam carrier 22 axially in the desired axial positions. For this purpose, the locking device may for example have an elastically preloaded blocking body. The blocking body may, in a first axial position of the cam carrier 22, engage into a first recess of the cam carrier 22 and, in a second axial position of the cam carrier 22, engage into a second recess of the cam carrier 22. The locking device may for example be provided in the shaft 12.

The force transmission device 16 has a first force transmission element 40, a second force transmission element 41, a lever axle 42 and a multiplicity of bearing blocks 43. The force transmission elements 40, 41 are arranged rotatably on the lever axle 42 so as to be pivotable about the lever axle 42. The lever axle 42 is mounted or held in the bearing blocks 43. The shaft 12 is mounted rotatably in the bearing blocks 43. It is for example also possible for separate bearing blocks to be provided for the lever axle 42 and the shaft 12.

In the embodiment shown, the force transmission elements 40, 41 are formed as rocker levers, and the lever axle 42 is thus formed as a rocker lever axle. It is however also possible for the force transmission elements 40, 41 to be formed as valve levers, and for the lever axle 42 to thus be formed as a valve lever axle.

In the embodiment illustrated, the first force transmission element 40 serves for actuating the first gas exchange valve 18, and the second force transmission element 41 serves for actuating the second gas exchange valve 20. It is however also possible, for example, for multiple gas exchange valves to be actuated by means of only one force transmission element, for example with the interposition of a valve bridge.

The force transmission elements 40, 41 have in each case one cam follower 44, 45, for example in the form of a rotatably mounted roller. The cam followers 44, 45 follow a cam contour of the cams 28-31 in a manner dependent on an axial position of the cam carrier 22.

In the first axial position of the cam carrier 22, the first force transmission element 40 is, by means of the cam follower 44, operatively connected between the first cam 28 and the first gas exchange valve 18. The second force transmission element 41 is, by means of the cam follower 45, operatively connected between the third cam 30 and the second gas exchange valve 20. The gas exchange valves 18, 20 are actuated in accordance with the cam contours of the first and second cams 28, 30.

In the second axial position of the cam carrier 22, the first force transmission element 40 is, by means of the cam follower 44, operatively connected between the second cam 29 and the first gas exchange valve 18. The second force transmission element 41 is, by means of the cam follower 45, operatively connected between the fourth cam 31 and the second gas exchange valve 20. The gas exchange valves 18, 20 are actuated in accordance with the cam contours of the second and fourth cams 29, 31. The situation is illustrated in FIGS. 1 and 2.

The first actuator 24 and the second actuator 26 are partially received (integrated) in the lever axle 42. This may be advantageous in particular from the aspect of optimum structural space utilization, because the actuators 24 and 26 thus require no or very little separate structural space. Here, the actuators 24 and 26 are carried by a carrying device 46, as described in detail below. It is however for example also possible for the first actuator 24 and/or the second actuator 26 to be carried outside the lever axle 42 (not separately illustrated) by means of a carrying device which is attached to the lever axle 42.

Figure 3:
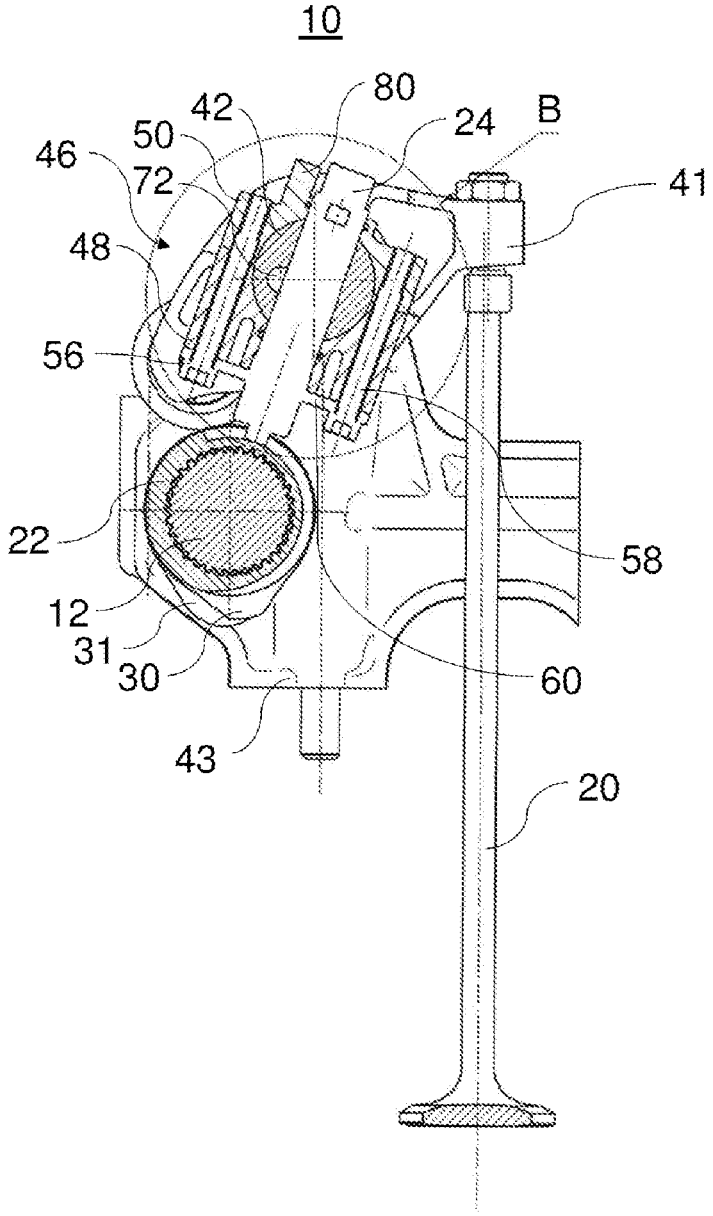
FIG. 3 is a sectional illustration of the exemplary variable valve drive along a line A-A in FIG. 2.
Figure 4:
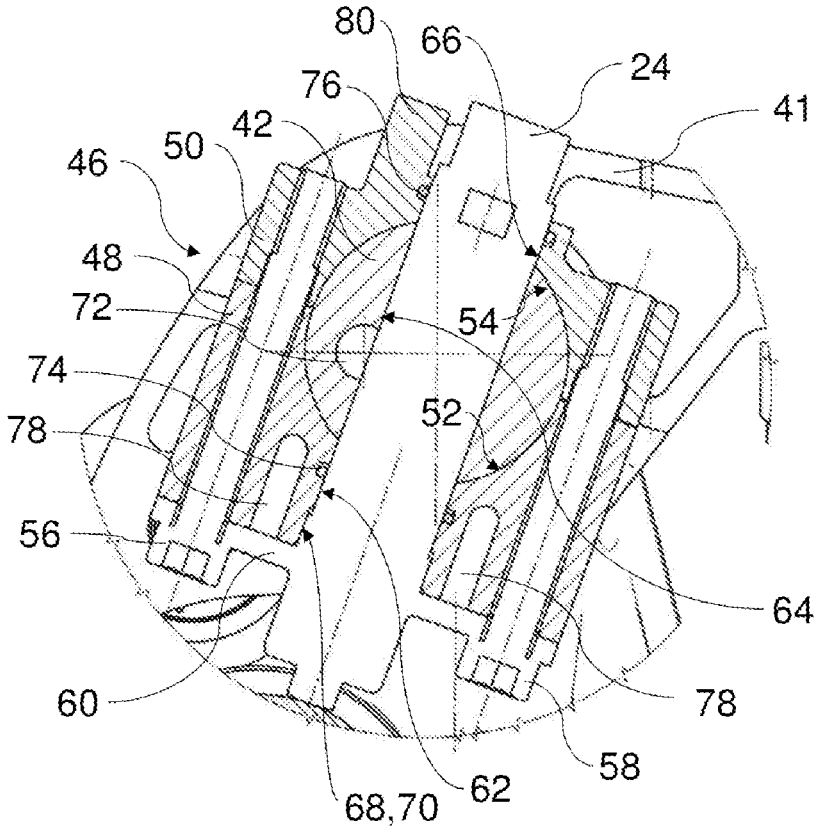
FIG. 4 is a detail illustration of a detail B of the exemplary variable valve drive of FIG. 3.

FIG. 3 shows a cross section through the shaft 12, the cam carrier 22 and the carrying device 46 along the line A-A in FIG. 2. FIG. 4 shows the detail B from FIG. 3 on an enlarged scale. As described below for the first actuator 24, the second actuator 26 may likewise be carried by the carrying device 46. This is to say, the carrying device 46 may be designed in the same way for carrying the second actuator 26 as for carrying the first actuator 24. For example, the carrying device 46 may be of substantially mirror-symmetrical design with respect to a central plane, which perpendicularly intersects the longitudinal axis of the lever axle 42, of the carrying device 46. The second actuator 26 may be designed in the same way as the first actuator 24.

The carrying device 46 engages fully around the lever axle 42. In this way, the flexible lever axle 42, which is further weakened owing to the fact that it receives the first actuator 24, can be stiffened. In particular, a flexible stiffness can be increased. The carrying device 46 may be of single-part or, as illustrated, multi-part construction.

The carrying device 46 has a first carrying element 48 and a second carrying element 50. The carrying elements 48, 50 have receiving shells 52, 54 facing toward one another. The receiving shells 52, 54 may be formed as half-shells. The receiving shells 52, 54 together form a receiving hole for receiving or surrounding (engaging around) the lever axle 42. The receiving shells 52, 54 are shaped so as to fit together with, in particular so as to correspond to, an outer circumferential shape of the lever axle 42. In particular, the receiving shells 52, 54 are of circular-cylinder-segment-shaped form.

The first carrying element 48 is detachably fastened to the second carrying element 50 by means of multiple screws 56, 58, wherein the carrying elements 48, 50 clamp the lever axle 42 between them. Here, the carrying elements 48, 50 are in contact with one another in the region of the screw 56, whereas said carrying elements are spaced apart from one another with a small gap (for example <1 mm) in the region of the screw 58, that is to say on an opposite side of the lever axle 42. By tightening the screw 58, the clamping force of the carrying elements 48, 50 on the lever axle 42 is increased. The screw 56 is tightened first. The carrying elements 48, 50 thus form a multi-part, ring-shaped clamp for the lever axle 42. As an alternative to the screws, use may for example also be made of other (for example detachable) fastening elements.

The carrying elements 48, 50 may be secured against rotation and axially on the lever axle 42. For this purpose, it is for example possible for a single pin (not illustrated) to be provided which protrudes beyond an outer circumference of the lever axle 42 and is received in corresponding receptacles of the carrying elements 48, 50.

By means of the screws (fastening elements) 56 and 58, the first actuator 24 is also detachably fastened to the carrying device 46, in particular to the first carrying element 48. In detail, the first actuator 24 is attached by means of a flange plate 60 to a surface of the carrying element 48 which faces toward the cam carrier 22.

The first actuator 24 is received in the first carrying element 48, the lever axle 42 and the second carrying element 50. For this purpose, the first actuator 24 extends through corresponding receiving holes 62, 64 and 66 in the first carrying element 48, in the lever axle 42 and in the second carrying element 50 respectively. The receiving holes 62, 64 and 66 share a common longitudinal axis and are oriented with one another. The receiving holes 62, 64 and 66 extend in particular perpendicularly with respect to a longitudinal axis of the lever axle 42.

The receiving hole 62 of the first carrying element 48 has an encircling shoulder 68 which fits together with an encircling shoulder 70 on the first actuator 24. The shoulder 68 is formed as a region of the receiving hole 62 with an enlarged diameter. The shoulder 70 is formed as a region of the first actuator 24 with an enlarged diameter. The shoulder 70 directly adjoins the flange plate 60. By means of the shoulders 68, 70, the first actuator 24 is supported in a transverse direction on the first carrying element 48 of the carrying device 46. It is thus possible for transverse forces that arise during the operation of the first actuator 24 during the displacement of the cam carrier 22 to be introduced directly into the first carrying element 48 without acting on the lever axle 42. Via the first carrying element 48, the transverse forces are then introduced into the lever axle 42, which finally conducts the transverse forces to the bearing blocks 43. It is thus possible to prevent the transverse forces from passing via a body of the first actuator 24 and for example deforming the latter.

The lever axle 42 has a fluid longitudinal channel 72. The fluid longitudinal channel 72 extends through the lever axle 42 eccentrically along a longitudinal axis of the lever axle 42. The fluid longitudinal channel 72 may for example be utilized for conducting a lubricating fluid for lubricating the bearing points of the force transmission elements 40, 41 (see FIGS. 1 and 2). The fluid longitudinal channel 72 intersects or crosses the receiving hole 64 in the lever axle 42. Seals 74, 76 are provided in order to prevent fluid leakage. The first seal 74 is seated in a circumferential groove in the receiving hole 62 of the first carrying element 48. The second seal 76 is seated in a circumferential groove in the receiving hole 66 of the second carrying element 50. The seals 74, 76 may for example be formed as O-rings.

The first carrying element 48 has a multiplicity of recesses 78 on a surface facing toward the flange plate 60. The recesses 78 are formed as pockets. The recesses 78 may increase a flexural elasticity of the first carrying element 48. It is thus possible, for example, for elevated stresses in the second carrying element 50 in the event of introduction of forces into the carrying device 46 by the first actuator 24 to be reduced.

Referring again to FIGS. 1 and 2, the second carrying element 50 has a holding region 80. The holding region 80 is arranged at an opposite side of the carrying device in relation to the cam carrier 22. The holding region 80 may be integrally connected as a single piece to the second carrying element 50, or may for example be attached to the second carrying element 50. For example, electric, pneumatic or hydraulic supply lines (not illustrated), in particular for the first actuator 24 and the second actuator 26, may be held at the holding region 80. For example, electric supply lines may be held if the actuators 24, 26 are in the form of electric actuators.

The carrying device 46 is furthermore arranged as a spacer on the lever axle 42 between the force transmission elements 40, 41. The first force transmission element 40 and the second force transmission element 41 are in particular arranged so as to bear against opposite end surfaces of the carrying device 46.

The present disclosure is not restricted to the exemplary embodiments described above. In fact, numerous variants and modifications are possible which likewise make use of the concept of the present disclosure and thus fall within the scope of protection. In particular, the present disclosure also claims protection for the subject matter and the features of the subclaims independently of the claims referred back to. In particular, the features of independent claim 1 are disclosed independently of one another. Furthermore, the features of the subclaims are also disclosed independently of all of the features of independent claim 1, and for example independently of the features relating to the presence, the arrangement and/or the configuration of the shaft, of the cam carrier, of the force transmission device, of the actuator device and of the carrying device of independent claim 1.

LIST OF REFERENCE DESIGNATIONS

10 Variable valve drive
12 Shaft
14 Sliding cam system
16 Force transmission device
18 First gas exchange valve
20 Second gas exchange valve
22 Cam carrier
24 First actuator
26 Second actuator
28 First cam
29 Second cam
30 Third cam
31 Fourth cam
32 First engagement track
34 Second engagement track
40 First force transmission element
41 Second force transmission element
42 Lever axle
43 Bearing block
44 Cam follower
45 Cam follower
46 Carrying device
48 First carrying element
50 Second carrying element
52 Receiving shell
53 Receiving shell
56 Screw
58 Screw
60 Flange plate
62 Receiving hole
64 Receiving hole
66 Receiving hole
68 Shoulder
70 Shoulder
72 Fluid longitudinal channel
74 Seal
76 Seal
78 Recess
80 Holding region

What is claimed is:

1. A variable valve drive, in particular with a sliding cam system, for an internal combustion engine, comprising:

a shaft;

a cam carrier which is arranged rotationally conjointly and axially displaceably on the shaft and which has a first cam and a second cam;

a force transmission device with a lever axle and with a first force transmission element which is pivotable about the lever axle and which, in a manner dependent on an axial position of the cam carrier, selectively produces an operative connection between the first cam and a gas exchange valve of the internal combustion engine or between the second cam and the gas exchange valve;

an actuator device for axially displacing the cam carrier; and a carrying device which at least partially engages around the lever axle and carries the actuator device, wherein the carrying device is designed to provide at least one of stiffening the lever axle by means of an engaging-around configuration, reducing a flexibility of the lever axle, or increasing a flexural stiffness of the lever axle.

2. The variable valve drive according to claim 1, wherein the actuator device includes a first actuator and a second actuator, the first and second actuators received at least partially in the lever axle or carried by the carrying device outside the lever axle.

3. The variable valve drive according to claim 1, wherein the carrying device is attached by means of a clamping connection to the lever axle or the carrying device forms a ring-shaped clamp for the lever axle.

4. The variable valve drive according to claim 1, wherein the carrying device is secured axially or rotationally conjointly on the lever axle by means of a pin.

5. The variable valve drive according to claim 1, wherein one or more actuators of the actuator device are received in at least one of a first carrying element or a second carrying element the carrying device.

6. The variable valve drive according to claim 1, wherein the carrying device has one or more receiving holes for receiving one or more actuators of the actuator device and the one or more receiving holes has a shoulder on which the one or more actuators is supported for purposes of accommodating transverse forces.

7. The variable valve drive according to claim 1, wherein the first force transmission element is a valve lever or a rocker lever.

8. The variable valve drive according to claim 1, wherein the force transmission device further has a second force transmission element which is pivotable about the lever axle and the carrying device is arranged as a spacer between the first force transmission element and the second force transmission element so as to directly join the first force transmission element and the second force transmission element.

9. The variable valve drive according to claim 8, wherein the second force transmission element is a valve lever or a rocker lever.

10. A motor vehicle having a variable valve drive according to claim 1.

11. A variable valve drive, in particular with a sliding cam system, for an internal combustion engine, comprising:

a shaft;

a cam carrier which is arranged rotationally conjointly and axially displaceably on the shaft and which has a first cam and a second cam;

a force transmission device with a lever axle and with a first force transmission element which is pivotable about the lever axle and which, in a manner dependent on an axial position of the cam carrier, selectively produces an operative connection between the first cam and a gas exchange valve of the internal combustion engine or between the second cam and the gas exchange valve;

an actuator device for axially displacing the cam carrier; and a carrying device which at least partially engages around the lever axle and carries the actuator device, wherein the carrying device has at least one contact surface, which fits together with an outer circumferential surface of the lever axle and which is of circular-cylinder-segment-shaped form, for at least partially engaging around the lever axle, which contact surface provides at least one of stiffening the lever axle by means of an engaging-around configuration, or reducing a flexibility of the lever axle or increasing a flexural stiffness of the lever axle.

12. A variable valve drive, in particular with a sliding cam system, for an internal combustion engine, comprising:

a shaft;

a cam carrier which is arranged rotationally conjointly and axially displaceably on the shaft and which has a first cam and a second cam;

a force transmission device with a lever axle and with a first force transmission element which is pivotable about the lever axle and which, in a manner dependent on an axial position of the cam carrier, selectively produces an operative connection between the first cam and a gas exchange valve of the internal combustion engine or between the second cam and the gas exchange valve;

an actuator device for axially displacing the cam carrier; and a carrying device which at least partially engages around the lever axle and carries the actuator device, wherein the carrying device engages in multi-part form around the lever axle or the carrying device has a first carrying element and a second carrying element which are fastened to one another and which each have a receiving half shell for forming a receptacle for the lever axle.

13. A variable valve drive, in particular with a sliding cam system, for an internal combustion engine, comprising:

a shaft;

a cam carrier which is arranged rotationally conjointly and axially displaceably on the shaft and which has a first cam and a second cam;

a force transmission device with a lever axle and with a first force transmission element which is pivotable about the lever axle and which, in a manner dependent on an axial position of the cam carrier, selectively produces an operative connection between the first cam and a gas exchange valve of the internal combustion engine or between the second cam and the gas exchange valve;

an actuator device for axially displacing the cam carrier; and a carrying device which at least partially engages around the lever axle and carries the actuator device, wherein one or more actuators of the actuator device are received in at least one of a first carrying element or a second carrying element of the carrying device, wherein a first bearing element and the second carrying element are attached by means of a clamping connection to the lever axle or the first carrying element and the second carrying element form a ring-shaped clamp from lever axle, or the first carrying element and the second carrying element make contact with one another on one side of the lever axle and are spaced apart from one another on an opposite side of the lever axle for clamping of the lever axle.

14. A variable valve drive, in particular with a sliding cam system, for an internal combustion engine, comprising:

a shaft;

a cam carrier which is arranged rotationally conjointly and axially displaceably on the shaft and which has a first cam and a second cam;

a force transmission device with a lever axle and with a first force transmission element which is pivotable about the lever axle and which, in a manner dependent on an axial position of the cam carrier, selectively produces an operative connection between the first cam and a gas exchange valve of the internal combustion engine or between the second cam and the gas exchange valve;

an actuator device for axially displacing the cam carrier; and a carrying device which at least partially engages around the lever axle and carries the actuator device, wherein the lever axle has an eccentric fluid longitudinal channel for feeding lubricating fluid for lubrication of a bearing point of the first force transmission element, which eccentric fluid longitudinal channel at least partially crosses a receiving hole of the lever axle for the actuator device and the carrying device is sealed off in order to prevent leakage.

15. A variable valve drive, in particular with a sliding cam system, for an internal combustion engine, comprising:

a shaft;

a cam carrier which is arranged rotationally conjointly and axially displaceably on the shaft and which has a first cam and a second cam;

a force transmission device with a lever axle and with a first force transmission element which is pivotable about the lever axle and which, in a manner dependent on an axial position of the cam carrier, selectively produces an operative connection between the first cam and a gas exchange valve of the internal combustion engine or between the second cam and the gas exchange valve;

an actuator device for axially displacing the cam carrier; and a carrying device which at least partially engages around the lever axle and carries the actuator device, wherein the actuator device is, by means of a flange plate, attached externally to a first carrying element of the carrying device.

16. The variable valve drive according to claim 15, wherein the first carrying element of the carrying device has at least one recess on a surface facing toward the flange plate, in order to increase a flexible elasticity of the carrying device.

17. A variable valve drive, in particular with a sliding cam system, for an internal combustion engine, comprising:

a shaft;

a cam carrier which is arranged rotationally conjointly and axially displaceably on the shaft and which has a first cam and a second cam;

a force transmission device with a lever axle and with a first force transmission element which is pivotable about the lever axle and which, in a manner dependent on an axial position of the cam carrier, selectively produces an operative connection between the first cam and a gas exchange valve of the internal combustion engine or between the second cam and the gas exchange valve;

an actuator device for axially displacing the cam carrier; and a carrying device which at least partially engages around the lever axle and carries the actuator device, wherein a second carrying element of the carrying device has a holding region for holding supply lines for the actuator device.

18. The variable valve drive according to claim 17, wherein the holding region is on a side of the carrying device averted from the cam carrier and the supply lines are electrical supply lines.

* * * * *